US006099997A

United States Patent [19]

Terrell et al.

[11] Patent Number: 6,099,997

[45] **Date of Patent: *Aug. 8, 2000**

[54] PHOTOCONDUCTIVE RECORDING MATERIAL COMPRISING A CROSSLINKED BINDER SYSTEM

[75] Inventors: David Terrell, Lint; Stefaan De Meutter, Antwerpen; Marcel Monbaliu, Mortsel, all of Belgium

[73] Assignee: Agfa-Gevaert, N.V., Mortsel, Belgium

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/670,144

[22] Filed: Jun. 27, 1996

Related U.S. Application Data

[63] Continuation of application No. 08/335,714, Nov. 10, 1994, abandoned.

[30] Foreign Application Priority Data

Jun. 4, 1992 [EP] European Pat. Off. ..... 92201613
May 21, 1993 [WO] WIPO ..... PCT/EP93/01282

[51] Int. Cl.[7] ..... G03G 5/05
[52] U.S. Cl. ..... 430/59.1; 430/58.25; 430/96
[58] Field of Search ..... 430/96, 134, 59.1, 430/58.25

[56] References Cited

U.S. PATENT DOCUMENTS

| | | | |
|---|---|---|---|
| 3,121,006 | 2/1964 | Middleton et al. | 430/56 |
| 3,226,227 | 12/1965 | Wolff . | |
| 3,368,893 | 2/1968 | Garrett | 430/96 |
| 3,707,402 | 12/1972 | Yamaguchi et al. | 430/134 |
| 4,424,269 | 1/1984 | Sasaki et al. | 430/96 |
| 4,490,452 | 12/1984 | Champ et al. | 430/58 |
| 4,546,059 | 10/1985 | Ong et al. | 430/58 |
| 4,609,602 | 9/1986 | Ong et al. | 430/58 |
| 5,312,708 | 5/1994 | Terrell et al. | 430/96 |
| 5,332,644 | 7/1994 | McNamara | 430/134 |
| 5,506,081 | 4/1996 | Terrel et al. | 430/96 |

FOREIGN PATENT DOCUMENTS

| | | |
|---|---|---|
| 145 959 | 6/1985 | European Pat. Off. . |
| 2952650 | 7/1980 | Germany . |
| 4028519 | 3/1991 | Germany . |

OTHER PUBLICATIONS

Diamond, Arthur S. (editor) Handbook of Imaging Materials. New York: Marcel–Dekker, Inc. pp. 387–392 & 427–436, 1991.

Alger, Mark S. (1989) Polymer Science Dictionary. Essex, England: Elsevier Science Publishers, Ltd. p. 151, 1989.

Database WPIL, Section Ch, Week 4788, Derwent Publications Ltd., London, GB; Class A12, AN 88–335800. (1988).

*Primary Examiner*—Christopher D. Rodee
*Attorney, Agent, or Firm*—Breiner & Breiner

[57] ABSTRACT

A photosensitive recording material containing a support and a charge generating layer (CGL) in contiguous relationship (contact) with a charge transporting layer (CTL), containing an n-charge transporting material (n-CTM), wherein the binder of the charge generating layer (CGL) is made insoluble in methylene chloride by crosslinking, and the binder is composed essentially of one or more polyepoxy compounds self-crosslinked under the influence of an amine catalyst and/or crosslinked by reaction with at least one primary and/or secondary poly NH-group amine.

6 Claims, No Drawings

PHOTOCONDUCTIVE RECORDING MATERIAL COMPRISING A CROSSLINKED BINDER SYSTEM

This is a continuation of application Ser. No. 08/335,714 filed Nov. 10, 1994 abondoned.

FIELD OF THE INVENTION

The present invention relates to photosensitive recording materials suitable for use in electrophotography.

BACKGROUND OF THE INVENTION

In electrophotography photoconductive materials are used to form a latent electrostatic charge image that is developable with finely divided colouring material, called toner.

The developed image can then be permanently affixed to the photoconductive recording material, e.g. a photoconductive zinc oxide-binder layer, or transferred from the photoconductor layer, e.g. a selenium or selenium alloy layer, onto a receptor material, e.g. plain paper and fixed thereon. In electrophotographic copying and printing systems with toner transfer to a receptor material the photoconductive recording material is reusable. In order to permit rapid multiple printing or copying, a photoconductor layer has to be used that rapidly loses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

A further important property which determines the suitability of a particular photoconductive material for electrophotographic copying is its photosensitivity, which must be sufficiently high for use in copying apparatuses operating with the fairly low intensity light reflected from the original. Commercial usefulness also requires that the photoconductive layer has a spectral sensitivity that matches the spectral intensity distribution of the light source e.g. a laser or a lamp. This enables, in the case of a white light source, all the colours to be reproduced in balance.

Known photoconductive recording materials exist in different configurations with one or more "active" layers coated on a conducting substrate and include optionally an outermost protective layer. By "active" layer is meant a layer that plays a role in the formation of the electrostatic charge image. Such a layer may be the layer responsible for charge carrier generation, charge carrier transport or both. Such layers may have a homogeneous structure or heterogeneous structure.

Examples of active layers in said photoconductive recording material having a homogeneous structure are layers made of vacuum-deposited photoconductive selenium, doped silicon, selenium alloys and homogeneous photoconducting polymer coatings, e.g. of poly(vinylcarbazole) or polymeric binder(s) molecularly doped with an electron (negative charge carrier) transporting compound or a hole (positive charge carrier) transporting compound such as particular hydrazones, amines and heteroaromatic compounds sensitized by a dissolved dye, so that in said layers both charge carrier generation and charge carrier transport take place.

Examples of active layers in said photoconductive recording material having a heterogeneous structure are layers of one or more photosensitive organic or inorganic charge generating pigment particles dispersed in a polymer binder or polymer binder mixture in the presence optionally of (a) molecularly dispersed charge transport compound(s), so that the recording layer may exhibit only charge carrier generation properties or both charge carrier generation and charge transport properties.

According to an embodiment that may offer photoconductive recording materials with particularly low fatigue a charge generating and charge transporting layer are combined in contiguous relationship. Layers which serve only for the charge transport of charge generated in an adjacent charge generating layer are e.g. plasma-deposited inorganic layers, photoconducting polymer layers, e.g. on the basis of poly(N-vinylcarbazole) or layers made of low molecular weight organic compounds molecularly distributed in a polymer binder or binder mixture.

Useful organic charge carrier generating pigments (CGM's) belong to one of the following classes:

a) perylimides, e.g. C.I. 71 130 (C.I.=Colour Index) described in DBP 2 237 539;

b) polynuclear quinones, e.g. anthanthrones such as C.I. 59 300 described in DBP 2 237 678;

c) quinacridones, e.g. C.I. 46 500 described in DBP 2 237 679;

d) naphthalene 1,4,5,8-tetracarboxylic acid derived pigments including the perinones, e.g. Orange GR, C.I. 71 105 described in DBP 2 239 923;

e) tetrabenzoporphyrins and tetranaphthaloporphyrins, e.g. $H_2$-phthalocyanine in X-crystal form (X-$H_2$Pc) described in U.S. Pat. No. 3,357,989, metal phthalocyanines, e.g. CuPc C.I. 74 160 described in DBP 2 239 924, indium phthalocyanine described in U.S. Pat. No. 4,713,312 and tetrabenzoporphyrins described in EP 428,214A; and naphthalocyanines having siloxy groups bonded to the central metal silicon described in published EP-A 243,205;

f) indigo- and thioindigo dyes, e.g. Pigment Red 88, C.I. 73 312 described in DBP 2 237 680;

g) benzothioxanthene derivatives as described e.g. in Deutsches Auslegungsschrift (DAS) 2 355 075;

h) perylene 3,4,9,10-tetracarboxylic acid derived pigments including condensation products with o-diamines as described e.g. in DAS 2 314 051;

i) polyazo-pigments including bisazo-, trisazo- and tetrakisazo-pigments, e.g. Chlordiane Blue C.I. 21 180 described in DAS 2 635 887, trisazo-pigments, e.g. as described in U.S. Pat. No. 4,990,421 and bisazo-pigments described in Deutsches Offenlegungsschrift (DOS) 2 919 791, DOS 3 026 653 and DOS 3 032 117;

j) squarylium dyes as described e.g. in DAS 2 401 220;

k) polymethine dyes;

l) dyes containing quinazoline groups, e.g. as described in GB-P 1,416,602 according to the following general formula:

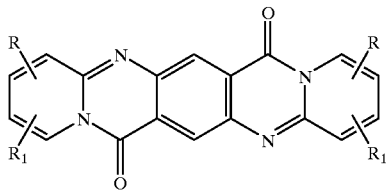

in which R and $R_1$ are either identical or different and denote hydrogen, $C_1$–$C_4$ alkyl, alkoxy, halogen, nitro or hydroxyl or together denote a fused aromatic ring system;

m) triarylmethane dyes; and n) dyes containing 1,5 diamino-anthraquinone groups.

o) inorganic photoconducting pigments e.g. Se, Se alloys, $As_2Se_3$, $TiO_2$, ZnO, CdS, etc.

Preferred non-polymeric materials for negative charge transport are:

a) dicyanomethylene and cyano alkoxycarbonylmethylene condensates with aromatic ketones such as 9-dicyanomethylene-2,4,7-trinitrofluorenone (DTF); 1-dicyanomethylene-indan-1-ones as described in EP 537,808 A with the formula:

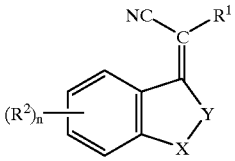

wherein $R^1$, $R^2$, X and Y have the meaning described in said EP 537,808 A;

compounds with the formula:

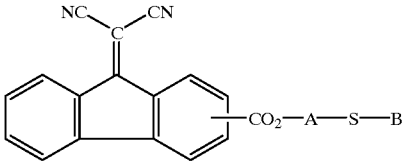

wherein: A is a spacer linkage selected from the group consisting of an alkylene group including a substituted alkylene group, a bivalent aromatic group including a substituted bivalent aromatic group; S is sulfur, and B is selected from the group consisting of an alkyl group including a substituted alkyl group, and an aryl group including a substituted aryl group as disclosed in U.S. Pat. No. 4,546,059;

and 4-dicyanomethylene 1,1-dioxo-thiopyran-4-one derivatives as disclosed in U.S. Pat. No. 4,514,481 and U.S. Pat. No. 4,968,813, e.g.

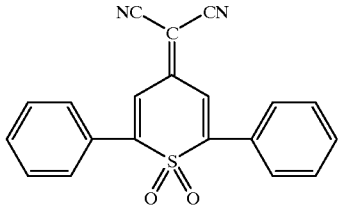

and

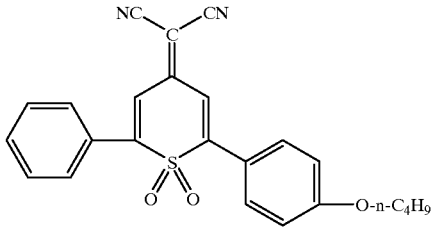

b) derivatives of malononitrile dimers as described in EP 534,004A;

c) nitrated fluorenones such as 2,4,7-trinitrofluorenone and 2,4,5,7-tetranitrofluorenone;

d) substituted 9-dicyanomethylene fluorene compounds as disclosed in U.S. Pat. No. 4,562,132;

e) 1,1,2-tricyanoethylene derivatives.

The choice of binder for the charge generating layer (CGL) for a given charge generating pigment (CGM) and a given charge transport layer (CTL) has a strong influence on the electro-optical properties of the photoreceptors. One or more of the following phenomena can have a negative influence on the electro-optical properties of the photoconductive recording material:

i) interfacial mixing between the CGL and the CTL resulting in CGM-doping of the CTL and CTM-doping of the CGL causing charge trapping;

ii) charge trapping in the CGL;

iii) poor charge transport in the CGL;

iv) poor charge transport blocking properties in the absence of a blocking layer.

Interfacial mixing between the CGL and the CTL can be avoided by using a CGL-binder or binders, which is/are insoluble in the solvent used for dissolving the CTL-binders in which CTM's exhibit optimum charge transport properties. Limited is the range of solvents in which efficient CTM's are soluble. The range of solvents in which both CTL-binders and CTM's are soluble is extremely narrow and often limited to chlorohydrocarbons such as methylene chloride. Methylene chloride is an extremely powerful solvent and the range of CGL-binders which is totally insoluble in methylene chloride is extremely limited, unless the CGL-binder is crosslinked in a subsequent hardening process.

Hardening is considered here as a treatment which renders the binder of a charge generating layer of the photoconductive recording material insoluble in methylene chloride.

SUMMARY OF THE INVENTION

It is an object of the present invention to provide a multiple layer photo-conductive recording material with improved photosensitivity.

It is still a further object of the present invention to provide a photoconductive recording material wherein interfacial mixing of the charge transporting layer with the charge generating layer is avoided during overcoating of the charge generating layer with a solution of the charge transporting layer composition.

It is still a further object of the present invention to provide a said photoconductive recording material wherein the binder system for the charge generating layer allows efficient charge transport in the charge generating layer and efficient charge injection into the charge transporting layer which is a negative charge transporting layer.

In accordance with the present invention a photoconductive recording material is provided containing a support and a charge generating layer (CGL) in contiguous relationship (contact) with a charge transporting layer (CTL), containing a n-charge transporting material (n-CTM), wherein the binder of said charge generating layer (CGL) is made insoluble in methylene chloride by crosslinking, and said binder is composed essentially of one or more polyepoxy compounds self-crosslinked (by self-condensation) under the influence of an amine catalyst and/or crosslinked by reaction with at least one primary and/or secondary poly NH-group amine.

DETAILED DESCRIPTION OF THE INVENTION

The amino groups in said amines can be blocked temporarily to form a stable coating composition wherefrom the amino groups are set free in situ in the coated layer. The blocking of the amino groups may proceed by transforming them into ketimine groups by reaction with a ketone, that is set free again by reaction with moisture ($H_2O$) [ref. the book "The Chemistry of Organic Film Formers" by D. H. Solomon, John Wiley & Sons, Inc. New York (1967), the chapter "Epoxy Resins", p. 190–191].

The self-condensation of epoxy resins under the action of basic catalysts such as monofunctional mines is described in said book on pages 186–188. Most epoxy resins are difunctional (or nearly) in terms of epoxy groups, whereby a crosslinked structure forms wish primary and/or secondary poly NH-group amines, e.g. ethylene diamine.

According to one embodiment a photoconductive recording material according to the present invention has a charge generating layer containing as the sole binder a crosslinked polymeric structure obtained through self-condensation of polyepoxy compounds in the presence of a catalytic amount of amine and/or through the reaction of poly poxy compounds, e.g. epoxy resins, with one or more primary and/or secondary poly NH-group amines.

According to another embodiment a photoconductive recording material according to the present invention has a charge generating layer containing one or more polyepoxy compounds, optionally epoxy resins, self-crosslinked in the presence of one or more catalytically acting amines wherein the concentration of said amines is between 2 and 15% by weight of the total weight of said polyepoxy compounds and amines.

According to a further embodiment a photoconductive recording material according to the present invention has a charge generating layer containing a binder having said polymeric structure derived from one or more polyepoxy compounds crosslinked with one or more of said poly NH-group amines wherein the equivalent ratio of the totality of epoxy groups and NH present in said polyamines is between 3.0:1 and 1:3.0.

According to a still further embodiment a photoconductive recording material according to the present invention has a charge generating layer containing a binder having said polymeric structure and at least 30 wt % of charge generating material(s).

Examples of polyepoxy compounds suitable for use according to the present invention are

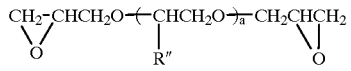

(I)

wherein R" is an alkyl group and a≧0

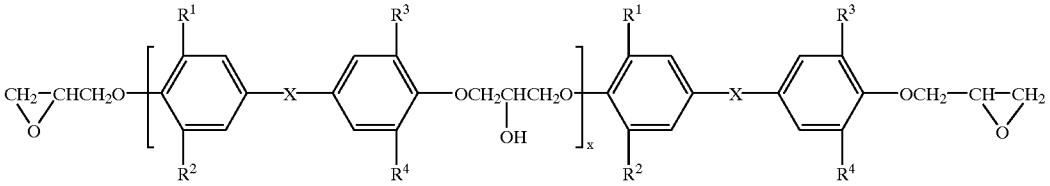

(II)

in which: X represents S, $SO_2$,

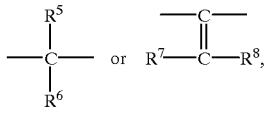

each of $R^1$, $R^2$, $R^3$, $R^4$, $R^7$ and $R^8$ (same or different) represents hydrogen, halogen, an alkyl group or an aryl group; each of $R^5$ and $R^6$ (same or different) represents hydrogen, an alkyl group, an aryl group or together represent the necessary atoms to close a cycloaliphatic ring, e.g. a cyclohexane ring; and x is zero or an integer.

(III)

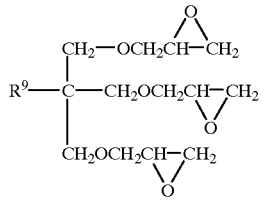

wherein $R^9$ is an alkyl group;

(IV)

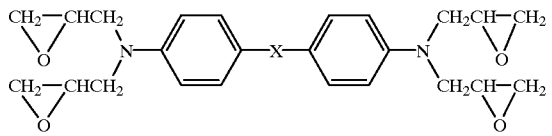

wherein X has the same meaning as above;

(V)

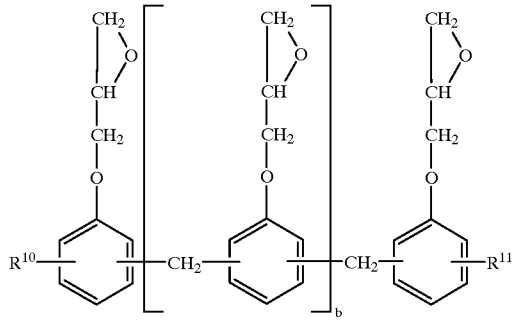

wherein each of $R^{10}$ and $R^{11}$ (same or different) represents hydrogen or an alkyl group and $b \geqq 0$.

Commercially available bisphenol A-epichlorhydrin epoxy resins according to formula II are:

EPON 1001
EPON 1002
EPON 1004
EPON 1007
EPON 1009 from Shell Chemical Co.

DER 331
DER 667
DER 668
DER 669 from Dow Chemical; and from Ciba-Geigy Switzerland:

ARALDITE GT 6071
ARALDITE GT 7203
ARALDITE GT 7097
ARALDITE GT 6099

A commercially available bisphenol F-epichlorhydrin epoxy resin according to formula II is:

ARALDITE GY 281 from Ciba-Geigy.

A commercially available epoxy resin according to formula IV is:

ARALDITE MY 721 from Ciba-Geigy.

Commercially available phenol novolak epoxy resins according to formula V are:

DEN 431
DEN 438
DEN 439 from Dow Chemical; and from Ciba-Geigy:

ARALDITE GY 1180
ARALDITE EPN 1138

Examples of amines for use according to this invention, which are able to render epoxy resins insoluble in methylene chloride by catalyzing the self-crosslinking of epoxy resins are cyclic aliphatic amines and tertiary amines, e.g.

piperidine
triethylamine
benzyldimethylamine (BDA)
2-dimethylaminomethylphenol (DMAMP)

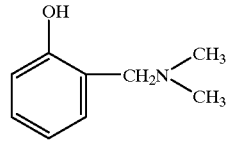

2,4,6-tris(dimethylaminomethyl)phenol (TDMAMP)

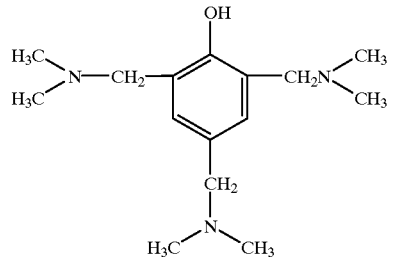

Examples of poly NH-group amines for use according to this invention, which are able to render epoxy resins insoluble in methylene chloride by crosslinking are:

i) aromatic poly NH-group amines and other amines e.g.
4,4'-diaminodiphenylmethane (DDM)-derivatives commercially available as EPICURE 153 from Shell Chemical and ARALDITE HY 830 from Ciba-Geigy;
4,4'-diaminodiphenylsulphone;
1,3,5-tris(4'-aminophenyl)benzene

AP1

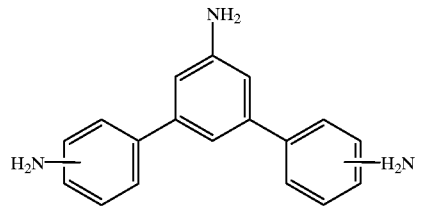

3,5-diphenylaniline

AP2

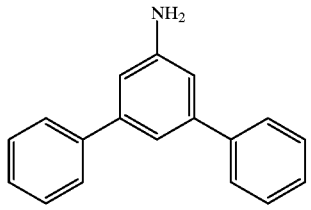

ii) poly NH-group amines wherein aliphatic amino groups are attached to an aromatic backbone e.g.:
meta-xylylene diamine commercially available as EPILINK MX from Akzo, The Netherlands;
phenalkamines on the basis of cashew nut shell liquid commercially available as CARDOLITE NC541 and CARDOLITE NC541 LV from Cardolite Corporation.

iii) cycloaliphatic poly NH-group amines e.g. isophorondiamine derivatives commercially available as EPILINK 420 (tradename) from Akzo, The Netherlands;

iv) heterocyclic poly NH-group amines e.g. 4-aminomethylpiperidine

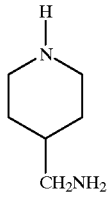

v) aliphatic amines e.g.
polyoxypropylene amines commercially available under the tradename JEFFAMINE from Texaco Chemical Company e.g. JEFFAMINE T-403 with the general formula:

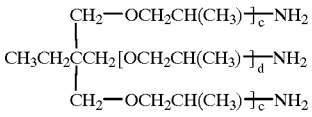

in which c+d+e is about 5.3
JEFFAMINE D-230 with the general formula:

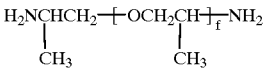

in which f is about 2.6
JEFFAMINE M-300 with the general formula:

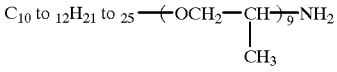

in which g is about 2.

The hardened polymeric binder structure obtained by self-condensation of polyepoxy compounds in the presence of catalytic amounts of amines and/or obtained by crosslinking reaction of polyepoxy compounds with primary and/or secondary poly NH-group amines may be used in combination with at least one other polymer serving as binding agent, e.g. in combination with acrylate and methacrylate resins, copolyesters of a diol, e.g. glycol, with isophthalic and/or terephthalic acid, polyacetals, polyurethanes, polyester-urethanes, aromatic polycarbonates, wherein a preferred combination contains at least 50% by weight of said hardened polymeric structure in the total binder content.

A polyester resin particularly suited for used in combination with said hardened resins is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Aromatic polycarbonates that are suitable for use in admixture with said epoxy resins hardened under the influence of amine catalysts and/or with said poly NH-group amines can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of following general formula (A):

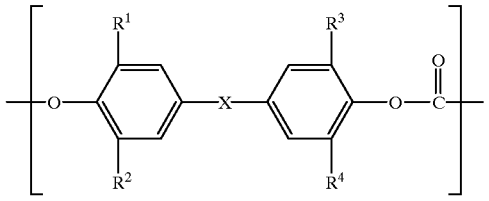

wherein: X, $R^1$, $R^2$, $R^3$ and $R^4$ have the same meaning as described in general formula (II) above.

Aromatic polycarbonates having a molecular weight in the range of 10,000 to 200,000 are preferred. Suitable polycarbonates having such a high molecular weight are sold under the registered trade mark MAKROLON of Bayer AG, W-Germany.

MASROLON CD 2000 (registered trade mark) is a bisphenol A polycarbonate with molecular weight in the range of 12,000 to 25,000 wherein $R^1=R^2=R^3=R^4=H$, X is

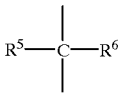

with $R^5=R^6=CH_3$.

MAKROLON 5700 (registered trade mark) is a bisphenol A polycarbonate with molecular weight in the range of 50,000 to 120,000 wherein $R^1=R^2=R^3=R^4=H$, X is

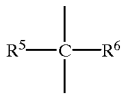

with $R^5=R^6=CH_3$.

Bisphenol Z polycarbonate is an aromatic polycarbonate containing recurring units wherein $R^1=R^2=R^3=R^4H$, X is

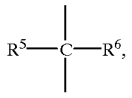

and $R^5$ together with $R^6$ represents the necessary atoms to close a cyclohexane ring.

Suitable electronically inactive binder resins for use in active layers of she present photoconductive recording material not containing said hardened polymeric structure are e.g. the above mentioned polyester and polycarbonates, but also cellulose esters, acrylate and methacrylate resins, e.g. cyanoacrylate resins, polyvinyl chloride, copolymers of vinyl chloride, e.g. copolyvinyl chloride/acetate and copolyvinyl chloride/maleic anhydride.

Further useful binder resins for an active layer are silicone resins, polystyrene and copolymers of styrene and maleic anhydride and copolymers of butadiene and styrene.

Charge transport layers in the photoconductors of the present invention preferably have a thickness in the range of 5 to 50 $\mu$m, more preferably in range of 5 to 30 $\mu$m. If these layers contain low molecular weight charge transport molecules, such compounds will preferably be present in concentrations of 30 to 70% by weight.

Preferred binders for the negative charge transporting charge transporting layers of the present invention are homo- or co-polycarbonates with the general formula:

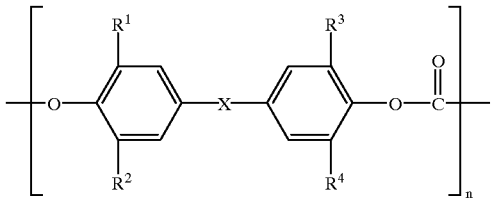

wherein X, $R^1$, $R^2R^3$ and $R^4$ have the same meaning as described in general formula (A) above. Specific polycarbonates useful as CTL-binders in the present invention are B1 to B7:

B1:

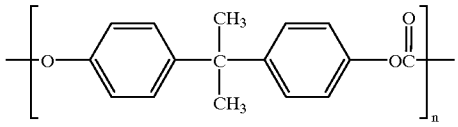

B2:

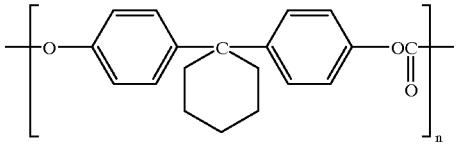

B3:

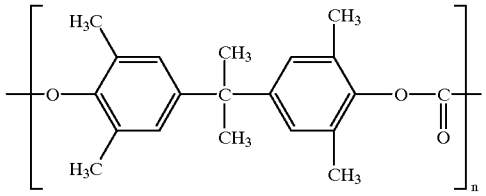

B4:

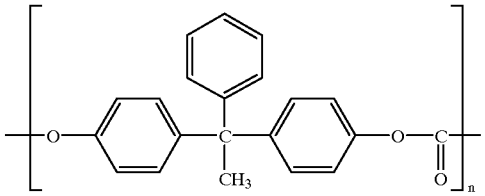

B5:

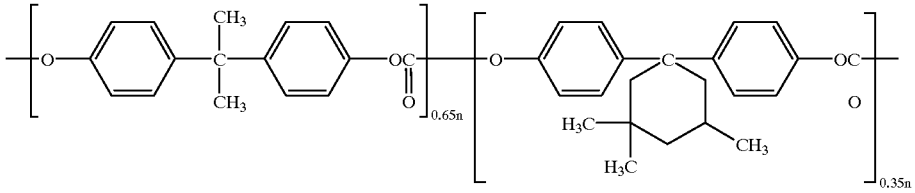

B6:

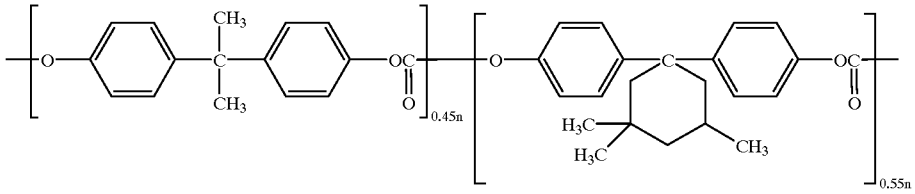

-continued

B7:

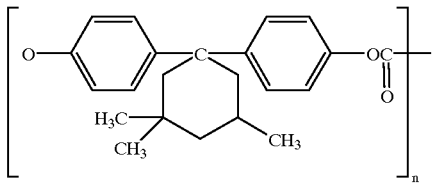

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain compounds substituted with electron-donor groups forming an intermolecular charge transfer complex, i.e. donor-acceptor complex wherein e.g. a hydrazone compound represents an electron donating compound. Useful compounds having electron-donating groups are hydrazones such as 4-N,N-diethylamino-benzaldehyde-,11-diphenylhydrazone (DEH), amines such as tris(p-tolylamine) (TTA) and N,N'-diphenyl-N,N'-bis(3-methyl-phenyl)-[1,1-biphenyl]-4,4'-diamine (TPD) etc. The optimum concentration range of said derivatives is such that the acceptor/donor weight ratio is 2.5:1 to 1,000:1.

Compounds acting as stabilising agents against deterioration by ultra-violet radiation, so-called UV-stabilizers, may also be incorporated in said charge transport layer. Examples of UV-stabilizers are benztriazoles.

For controlling the viscosity of the coating compositions and controlling their optical clarity silicone oils may be added to the charge transport layer.

The charge transport layer used in the recording material according to the present invention possesses the property of offering a high charge transport capacity coupled with a low dark discharge. While with the common single layer photoconductive systems an increase in photosensitivity is coupled with an increase in the dark current and fatigue such is not the case in the double layer arrangement wherein the functions of charge generation and charge transport are separated and a photosensitive charge generating layer is arranged in contiguous relationship to a charge transporting layer.

As charge generating compounds for use in a recording material according to the present invention any of the organic pigment dyes belonging to one of the following classes and able to transfer electrons to electron transporting materials may be used:

a) perylimides, e.g. C.I. 71 130 (C.I.=Colour Index) described in DBP 2 237 539, b) polynuclear quinones, e.g. anthanthrones such as C.I. 59 300 described in DBP 2 237 678, c) quinacridones, e.g. C.I. 46 500 described in DBP 2,237,679, d) naphthalene 1,4,5,8-tetracarboxylic acid derived pigments including the perinones, e.g. Orange GR, C.I. 71 105 described in DBP 2 239 923, e) tetrabenzoporphyrins and tetranaphthaloporphyrins, e.g. $H_2$-phthalocyanine in X-crystal form (X-$H_2$Pc) described in U.S. Pat. No. 3,357,989, metal oxyphthalocyanines, metal phthalo-cyanines, e.g. CuPc C.I. 74 160 described in DBP 2 239 924, indium phthalocyanine described in U.S. Pat. No. 4,713,312, tetrabenzoporphyrins described in EP 428,214A, silicon naphthalocyanines having siloxy groups bonded to the central silicon as described in EP-A 0243205 and X- and B-morphology $H_2Pc(CN)_x$, $H_2PC(CH_3)_x$ and $H_2PcCl_x$ pigments, f) indigo- and thioindigo dyes, e.g. Pigment Red 88, C.I. 73 312 described in DBP 2 237 680, g) benzothioxanthene-derivatives as described e.g. in DAS 2,355,075, h) perylene 3,4,9,10-tetracarboxylic acid derived pigments including condensation products with o-diamines as described e.g. in DAS 2 314 051, i) polyazo-pigments including bisazo-, trisazo- and tetrakisazo-pigments, e.g. Chlordiane Blue C.I. 21 180 described in DAS 2 635 887, and bisazopigments as described in DOS 2 919 791, DOS 3 026 653 and DOS 3 032 117, j) squarilium dyes as described e.g. in DAS 2,401,220, k) polymethine dyes.

l) dyes containing quinazoline groups, e.g. as described in GB-P 1,416,602 according to the following general formula:

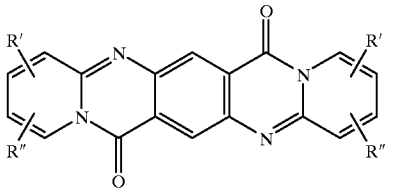

Inorganic substances suited for photogenerating negative charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

The thickness of the charge generating layer is preferably not more than 10 $\mu$m, more preferably not more than 5 $\mu$m.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as a blocking layer preventing positive or negative charge injection from the support side. The thickness of said barrier layer is preferably not more than 1 micron.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

According to a particular embodiment the support is an insulating resin support provided with an aluminium layer forming a conducting coating.

The support may be in the form of a foil, web or be part of a drum.

An electrophologrаphic recording process according to the present invention comprises the steps of:

(1) overall electrostatically charging, e.g. with corona-device, the photoconductive material containing in a charge generating layer said hardened polymeric structure as a binding agent;

(2) image-wise photo-exposing said layer thereby obtaining a latent electrostatic image, that may be toner-developed.

When applying a bilayer-system electrophotographic recording material including on an electrically conductive support, a photosensitive charge generating layer in continguous relationship with a charge transporting layer, the photo-exposure of the charge generating layer proceeds preferably through the charge transporting layer but may be direct if the charge generating layer is uppermost or may proceed likewise through the conductive support if the latter is transparnt enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, N.Y., enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. The evaluations of electrophotographic properties determined on the recording materials of the following examples relate to the performance of the recording materials in an electrophotographic process with a reusable photoreceptor. The measurements of the performance characteristics were carried out by using a sensitometric measurement in which the discharge was obtained for 16 different exposures including zero exposure. The photoconductive recording sheet material was mounted with its conductive backing on an aluminium drum which was earthed and rotated at a circumferential speed of 10 cm/s. The recording material was sequentially charged with a positive corona at a voltage of +5.7 kV operating with a grid voltage of +600 V. Subsequently the recording material was exposed (simulating image-wise exposure) with a light dose of monochromatic light obtained from a monochromator positioned at the circumference of the drum at an angle of 45° with respect to the corona source. The photo-exposure lasted 200 ms. Thereupon, the exposed recording material passed an electrometer probe positioned at an angle of 30° with respect to the corona source. After effecting an overall post-exposure with a halogen lamp producing 355 mJ/m2 positioned at an angle of 270° with respect to the corona source a new copying cycle started. Each measurement relates to 80 copying cycles in which the photoconductor is exposed to the full light source intensity for the first 5 cycles, then sequentially to the light source the light output of which is moderated by grey filters of optical densities 0.2, 0.38, 0.55, 0.73, 0.92, 1.02, 1.20, 1.45, 1.56, 1.70, 1.95, 2.16, 2.25, 2.51 and 3.21 each for 5 cycles and finally to zero light intensity for the last 5 cycles.

The electro-optical results quoted in the EXAMPLES 1 to 56 hereinafter refer to charging level at zero light intensity (CL) and to discharge at a light intensity corresponding to the light source intensity moderated by a grey filter to the exposure indicated to a residual potential RP.

The % discharge is:

$$\frac{(CL-RP)}{CL}\times 100.$$

For a given corona voltage, corona current, separating distance of the corona wires to recording surface and drum circumferential speed the charging level CL is only dependent upon the thickness of the charge transport layer and its specific resistivity. In practice CL expressed in volts should be preferably ≧30d, where d is the thickess in μm of the charge transport layer.

Charge generating materials (CGM's) used in the following examples have the following formulae:

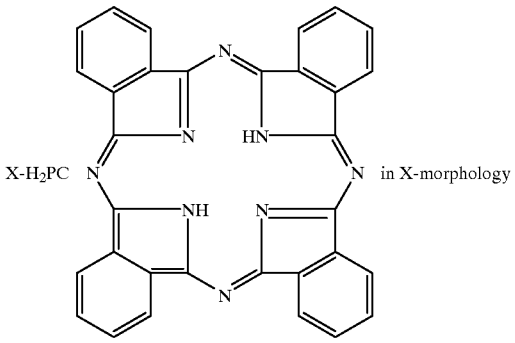

X-$H_2Pc(CN)_{0.36}$ : a mixed crystal in 1.75:1 molar ratio of $H_2Pc$ and

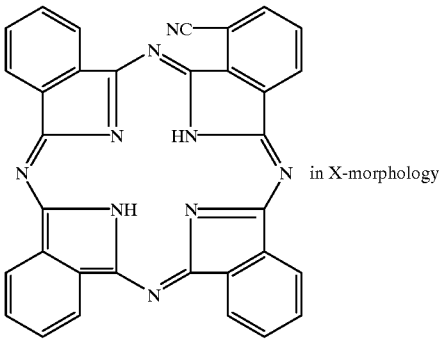

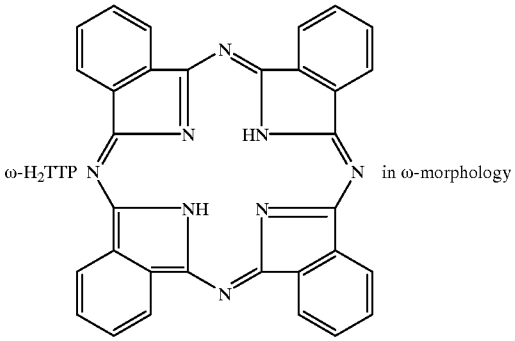

-continued

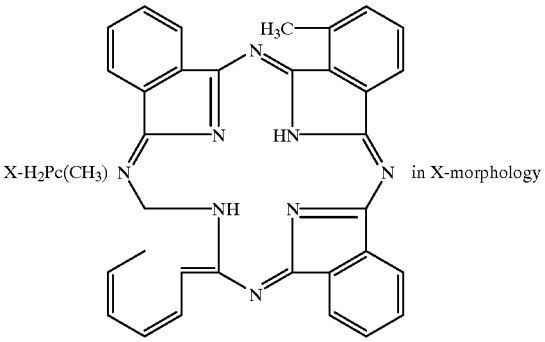

X-$H_2Pc(Cl)_{0.67}$ : a mixed crystalline pigment of 0.5:1 molar ratio of $H_2Pc$ and

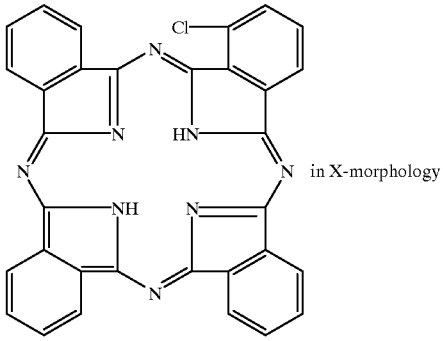

DBA:

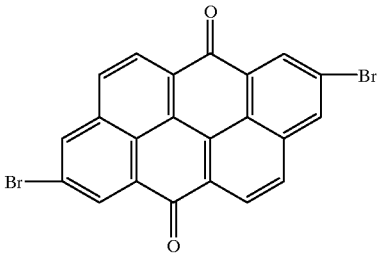

Perylene pigment:

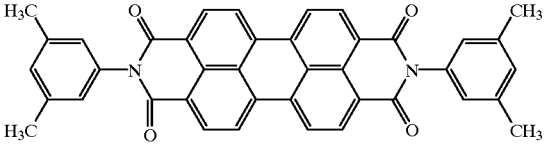

CIM-compounds being electron-transporting compounds (N1 to N8) used in the Examples have the following formulae:

(N1)

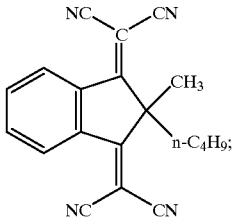

-continued (N2)

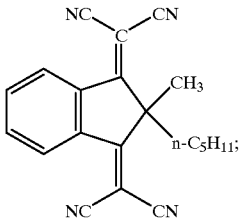

(N3)

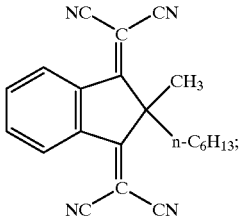

(N4)

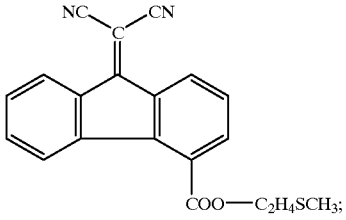

(N5)

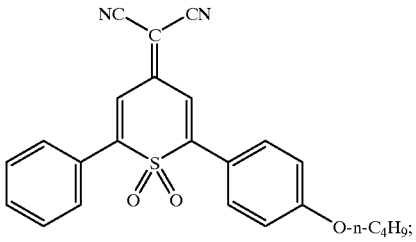

(N6)

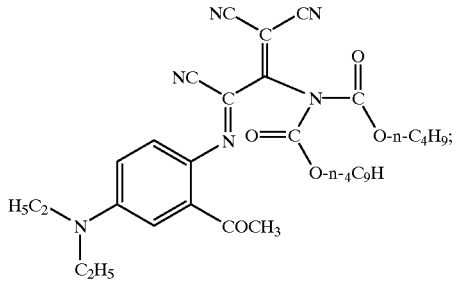

(N7)

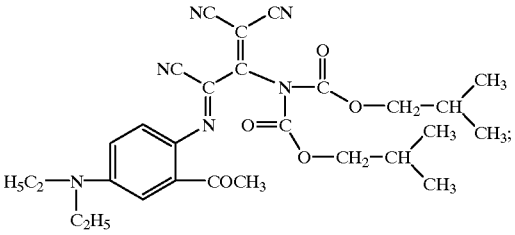

-continued (N8)

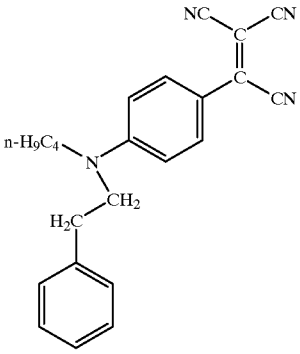

All ratios and percentages mentioned in the Examples are by weight.

EXAMPLE 1

In the production of a composite layer electrophotographic recording material a 175 $\mu$m thick polyester film pre-coated with a vacuum-deposited layer of aluminium was doctor-blade coated with a dispersion of charge generating pigment to a thickness of 0.9 $\mu$m with a doctor-blade coater.

Said dispersion was prepared by mixing 2 g of metal-free X-phthalocyanine (FASTOGEN BLUE 8120B from Dainippon Ink and Chemicals Inc.); 0.3 g of ARALDITE GT 7203 (tradename), bisphenol A-epichlorhydrin epoxy resin from Ciba Geigy, 16.83 g of methylene chloride and 9.62 g of butan-2-one for 40 hours in a ball mill. 1.47 g of ARALDITE GT 7203 (tradename), 4.36 g of butan-2-one, 9.63 g of methylene chloride and 0.23 g of Jeffamine T-403, a polyoxypropylene amine from Texaco Chemical Company, as hardener were then added to the dispersion and the dispersion mixed for a further 15 minutes.

The applied layer was dried and thermally hardened for 2 hours at 100° C. and then overcoated using a doctor blade coater with a filtered solution of 1.5 g of the CTM N3; 1.83 g of MAKROLON 5700 (tradename), a bisphenol A-polycarbonate from Bayer A.G.; and 24.42 g of methylene chloride to a thickness of 15.1 $\mu$m after drying at 50° C. for 16 hours.

The electro-optical characteristics of the thus obtained photoconductive recording material were determined as described above. At a charging level (CL) of +546V and an exposure DOSE OF 660 nm light ($I_{660}t$) of 20 mJ/m$^2$, the following results were obtained:

CL=+546 V

RP=+107 V

% discharge: 80.4

EXAMPLES 2 TO 5

The photoconductive recording materials of examples 2 to 5 were produced as described for example 1 except that the amounts of ARALDITE GT7203 (tradename) and JEFFAMINE T-403 (tradename) were adjusted to obtain various theoretical degress of hardening, as indicated in Table 1, and the CTM used was N2 instead of N3. The weight percentages of ARALDITE GT 7203 (tradename) and JEFFAMINE T-403 (tradename) calculated on the basis of the solids content of the reactants are also given in Table 1 together with the CTL layer thicknesses ($d_{CTL}$).

The electro-optical characteristics of the thus obtained photoconductive recording materials were determined as described above and the results are summarized in Table 1.

TABLE 1

| Example No. | ARALDITE GT 7203 conc. [wt %] | JEFFAMINE T-403 conc. [wt %] | Theoretical degree of hardening [%] | $d_{CTL}$ [μm] | $I_{660}t$ = 20 mJ/m² CL [V] | RP [V] | % discharge |
|---|---|---|---|---|---|---|---|
| 2 | 41.85 | 8.15 | 150 | 12.1 | +540 | +102 | 81.1 |
| 3 | 44.26 | 5.74 | 100 | 13.1 | +536 | +98 | 81.7 |
| 4 | 45.57 | 4.43 | 75 | 12.1 | +543 | +95 | 82.5 |
| 5 | 46.95 | 3.05 | 50 | 13.1 | +535 | +94 | 82.4 |

EXAMPLES 6 and 7

The photoconductive recording materials of examples 6 and 7 were produced as described for example 1 except that different epoxy resins from different suppliers were used instead of ARALDITE GT7203 (tradename) and N2 was used as the CTM instead of N3. The amounts of epoxy resin and JEFFAMINE T-403 (tradename) were adjusted to obtain a theoretical degree of hardening of 100%. The weight percentages of epoxy resin and JEFFAMINE T-403 (tradename) calculated on the basis of the solids content of the reactants are given in Table 2 together with the CTL layer thicknesses ($d_{CTL}$).

The electro-optical characteristics of the thus obtained photoconductive recording materials were determined as described above and the results are summarized in Table 2 together with those for the photoconductive recording material of example 3.

TABLE 2

| Example No. | Epoxy resin | Epoxy resin conc. [wt %] | JEFFAMINE T-403 conc. [%] | $d_{CTL}$ [μm] | $I_{660}T$ = 20 mJ/m² CL [V] | RP [V] | % discharge |
|---|---|---|---|---|---|---|---|
| 3 | ARALDITE GT7203 | 44.26 | 5.74 | 13.1 | +536 | +98 | 81.7 |
| 6 | ARALDITE GY 281 | 33.53 | 16.47 | 13.1 | +489 | +89 | 81.8 |
| 7 | DEN 438 | 34.39 | 15.61 | 13.1 | +473 | +95 | 79.9 |

EXAMPLES 8 to 12

The photoconductive recording materials of examples 8 to 12 were produced as described for example 1 except the different CTM's were used instead of N3. In example 9 in the CTM layer TPD as defined hereinbefore was present in a concentration of 11.1 wt %. CTL layer thicknesses ($d_{CTL}$) are given in Table 3.

The electro-optical characteristics of the thus obtained conductive recording materials were determined as described and the results are summarized together with those for the conductive recording materials of examples 1 and 3 in Table 3.

TABLE 3

| Example No. | CTM | CTM conc. [wt. %] | $d_{CTL}$ [μm] | λ [nm] | It = 20 mJ/m² CL [V] | RP [V] | % discharge |
|---|---|---|---|---|---|---|---|
| 8 | N1 | 45 | 12.1 | 780 | +553 | +102 | 81.6 |
| 3 | N2 | 45 | 13.1 | 660 | +536 | +98 | 81.7 |
| 1 | N3 | 45 | 15.1 | 660 | +546 | +107 | 80.4 |
| 9 | N4 | 44.4 | 13.1 | 780 | +481 | +85 | 82.3 |
| 10 | N6 | 50 | 14.1 | 780 | +415 | +183 | 55.9 |
| 11 | N7 | 50 | 14.1 | 780 | +407 | +175 | 57.0 |
| 12 | N8 | 50 | 14.1 | 780 | +508 | +295 | 41.9 |

EXAMPLES 13 to 18

The photoconductive recording materials of examples 13 to 18 were produced as described for example 3 except that different CGM's were used (as indicated in Table 4). The thicknesses of the CTL layers ($d_{CTL}$) are given in Table 4.

The electro-optical characteristics of the thus obtained photoconductive recording materials were determined as described above and the results are summarized together with those for the photoconductive recording material of example 3 in Table 4.

TABLE 4

| Example No. | CGM | $d_{CTL}$ [μm] | λ [nm] | It = 20 mJ/m2 CL [V] | RP [V] | % discharge |
|---|---|---|---|---|---|---|
| 3 | FASTOGEN BLUE 8120B | 13.1 | 660 | +536 | +98 | 81.7 |
| 13 | X-$H_2Pc(CN)_{0.36}$ | 11.1 | 660 | +302 | +91 | 69.9 |
| 14 | ω-$H_2TTP$ | 12.1 | 660 | +543 | +218 | 59.9 |
| 15 | X-$H_2Pc(CH_3)$ | 11.1 | 660 | +576 | +251 | 56.4 |
| 16 | X-$H_2PcCl_{0.67}$ | 12.1 | 660 | +575 | +226 | 60.7 |
| 17 | DBA | 12.1 | 540 | +323 | +136 | 57.9 |
| 18 | Perylene pigment | 12.1 | 540 | +134 | +111 | 17.2 |

EXAMPLES 19 and 20

The photoconductive recording materials of examples 19 and 20 were produced as described for example 1 except that different polyoxypropylene amines were used (as indicated in Table 5) instead of JEFFAMINE T-403 (tradename) and N1 was used as the CTM instead of N3. The amounts of ARALDITE GT7203 (tradename) and polyoxypropylene amine were adjusted to obtain a theoretical degree of hardening of 100%. The weight percentages of ARALDITE GT7203 (tradename) and polyoxypropylene amine calculated on the basis of the solids content of the reactants are given in Table 5 together with the CTL layer thicknesses [$d_{CTL}$].

The electro-optical characteristics of the thus obtained photoconductive recording materials were determined as described above and the results are summarized in Table 5 together with those for the photoconductive recording material of example 8.

TABLE 5

| Example No. | ARALDITE GT7203 conc. [wt %] | Polyoxypropylene amine | Amine conc. [wt %] | $d_{CTL}$ [μm] | It = 20 mJ/m² λ [nm] | CL [V] | RP [V] | % discharge |
|---|---|---|---|---|---|---|---|---|
| 8 | 44.26 | JEFFAMINE T-403 | 5.74 | 12.1 | 780 | +553 | +102 | 81.6 |
| 19 | 40.65 | JEFFAMINE M-300 | 9.35 | 14.1 | 660 | +574 | +153 | 73.3 |
| 20 | 45.87 | JEFFAMINE D-230 | 4.13 | 12.1 | 660 | +572 | +146 | 74.5 |

EXAMPLES 21 to 33

The photoconductive recording materials of examples 21 to 33 were produced as described for example 1 except that different epoxy resins were used (as indicated in Table 6) instead of ARALDITE GT7203 (tradename) with the exception of example 22; EPICURE 153 (tradename for an aromatic amine hardener from Shell Chemical derived from 4,4'-diaminodiphenyl methane), was used as the hardener instead of JEFFAMINE T-403 (tradename); and different CTM's were used as indicated in Table 6. The amounts of epoxy resin and EPICURE 153 (tradename) were adjusted to obtain a theoretical degree of hardening of 100%. The weight percentages of the epoxy resins and EPICURE 153 (tradename) calculated on the basis of the solids content of the reactants are given in Table 6 together with the CTL layer thicknesses [$d_{CTL}$].

The electro-optical characteristics of the thus obtained photoconductive recording materials were determined as described above and the results are summarized in Table 6.

TABLE 6

| Example No. | Epoxy resin | Epoxy resin conc. [wt %] | EPICURE 153 conc. [wt %] | CTM | $d_{CTL}$ [μm] | $I_{660}t$ = 20 mJ/m² CL [V] | RP [V] | % discharge |
|---|---|---|---|---|---|---|---|---|
| 21 | ARALDITE GT7203 | 42.25 | 7.75 | N1 | 12.1 | +480 | +106 | 77.9 |
| 22 | EPON 828 | 31.1 | 18.9 | N1 | 10.1 | +476 | +117 | 75.4 |
| 23 | ARALDITE GT609 | 7.93 | 2.07 | N2 | 13.1 | +547 | +131 | 76.1 |
| 24 | DER 668 | 48 | 2 | N2 | 13.1 | +540 | +132 | 75.6 |
| 25 | DER 669 | 48.75 | 1.25 | N2 | 14.1 | +560 | +138 | 75.4 |
| 26 | EPON 1009 | 48.29 | 1.71 | N2 | 13.1 | +555 | +124 | 77.7 |
| 27 | ARALDITE GY 281 | 29.45 | 20.55 | N1 | 11.1 | +467 | +105 | 77.5 |
| 28 | DEN 431 | 30.20 | 19.80 | N3 | 12.1 | +465 | +108 | 76.8 |
| 29 | DEN 438 | 30.41 | 19.59 | N3 | 13.1 | +440 | +103 | 76.6 |
| 30 | DEN 439 | 31.77 | 18.23 | N3 | 12.1 | +456 | +108 | 76.3 |
| 31 | ARALDITE GY1180 | 30.35 | 19.65 | N1 | 11.1 | +472 | +118 | 75.0 |
| 32 | ARALDITE EPN1138 | 30.41 | 19.59 | N2 | 16.1 | +448 | +120 | 73.2 |
| 33 | ARALDITE MY721 | 26.04 | 23.96 | N2 | 12.1 | +401 | +112 | 72.1 |

EXAMPLES 34 AND 35

The photoconductive recording materials of examples 34 and 35 were produced as described for example 1 except that different 4,4-diaminodiphenylmethane-based hardeners (as indicated in Table 7) were used instead of JEFFAMINE T-403 (tradename) and different CTM's were used as indicated in Table 7. The amounts of epoxy resin and DDM-based hardeners were adjusted to obtain a theoretical degree of hardening of 100%. The weight percentages of epoxy resin and the DDM-based hardeners calculated on the basis of the solids content of the reactants are given in Table 7 together with the CTL layer thicknesses.

The electro-optical characteristics of the thus obtained photoconductive recording materials were determined as described above and the results are summarized in Table 7 together with those for the photoconductive recording material of example 21.

TABLE 7

| Example No. | ARALDITE GT7203 conc. [wt %] | DDM-based hardener | DDM-based hardener conc. [wt %] | CTM | $d_{CTL}$ [μm] | $I_{660}t$ = 20 mJ/m² CL [V] | RP [V] | % discharge |
|---|---|---|---|---|---|---|---|---|
| 21 | 42.25 | EPICURE 153 | 7.75 | N1 | 12.1 | +480 | +106 | 77.9 |
| 34 | 42.23 | ARALDITE HY830 | 7.77 | N2 | 13.1 | +553 | +104 | 81.2 |
| 35 | 46.3 | 4,4'-diaminodi-phenylmethane | 3.7 | N1 | 11.1 | +537 | +126 | 76.5 |

EXAMPLES 36 AND 37

The photoconductive recording materials of examples 36 and 37 were produced as described for example 21 except that different CGM's were used (as indicated in Table 8) and different CTM's were used as indicated in Table 8. The layer thicknesses ($d_{CTL}$) of the CTL's are also given in Table 8.

The electro-optical characteristics of the thus obtained photoconductive recording materials were determined as described above and the results are summarized together with those for the photoconductive recording material of example 21 in Table 8.

TABLE 8

| Example No. | CGM | CTM | $d_{CTL}$ [μm] | $I_{660}t$ = 20 mJ/m² CL [V] | RP [V] | % discharge |
|---|---|---|---|---|---|---|
| 21 | FASOTGEN BLUE 8120B | N1 | 12.1 | +480 | +106 | 77.9 |
| 37 | X-$H_2Pc(CN)_{0.36}$ | N2 | 11.1 | +384 | +107 | 72.1 |
| 38 | ω-$H_2TTP$ | N2 | 13.1 | +513 | +214 | 58.3 |

EXAMPLES 38 AND 39

The photoconductive recording materials of examples 38 and 39 were produced as described for example 1 except that ARALDITE MY 721 (tradename) was used in the case of example 39 instead of ARALDITE GT7203 (tradename), 4,4'-diaminodiphenylsulfone (DDS) was used as the amine hardener instead of JEFFAMINE T-403 (tradename), different CTM's were used as indicated in Table 9 and the charge generation layer of the photoconductive recording material of example 38 was hardened for 24 hours at 100° C. instead of 2 hours at 100° C. The amounts of epoxy resin and DDS were adjusted to obtain a theoretical degree of hardening of 100%. The weight percentages of the reactants calculated on the basis of their solids contents are given in Table 9 together with the CTL layer thicknesses ($d_{CTL}$)

The electro-optical characteristics of the thus obtained photoconductive recording materials were determined ad described above and the results are summarized in Table 9.

TABLE 9

| Example No. | Epoxy resin | Epoxy resin conc. [wt %] | DDM conc. [wt %] | CTM | $d_{CTL}$ [μm] | $I_{660}t$ = 20 mJ/m² CL [V] | RP [V] | % discharge |
|---|---|---|---|---|---|---|---|---|
| 38 | ARALDITE GT7203 | 45.5 | 4.5 | N1 | 11.1 | +533 | +122 | 77.1 |
| 39 | ARALDITE MY721 | 33.41 | 16.59 | N2 | 15.1 | +492 | +100 | 79.7 |

EXAMPLES 40 AND 42

The photoconductive recording materials of examples 40 to 42 were produced as described for example 1 except that with the exception of example 40 alternative epoxy resins were used (as indicated in Table 10) instead of ARALDITE GT7203 (tradename), 1,3,5-tris(4'-aminophenyl)benzene was used as the hardener instead of JEFFAMINE T-403 (tradename) and different CTM's were used as indicated in Table 10. The amounts of epoxy resin and 1,3,5-tris(4'-aminophenyl)benzene were adjusted to obtain a theoretical degree of hardening of 100%. The weight percentages of the reactants based on their solids contents are given in Table 10 together with the CTL layer thicknesses ($d_{CTL}$).

The electro-optical characteristics of the thus obtained photoconductive recording materials were determined as described above and the results are summarized in Table 10.

TABLE 10

| Example No. | Epoxy resin | Epoxy resin conc. [wt %] | 1,3,5tris (4'-amino-phenylbenzene conc. [wt %] | CTM | $d_{CTL}$ [μm] | $I_{660}t$ = 20 mJ/m² CL [V] | RP [V] | % discharge |
|---|---|---|---|---|---|---|---|---|
| 40 | ARALDITE GT7203 | 45.71 | 4.29 | N1 | 10.1 | +541 | +126 | 76.7 |
| 41 | ARALDITE GY281 | 36.9 | 13.1 | N2 | 14.1 | +530 | +120 | 77.4 |
| 42 | DEN 438 | 37.64 | 12.36 | N2 | 14.1 | +563 | +140 | 75.1 |

EXAMPLES 43 AND 44

The photoconductive recording materials of examples 43 and 44 were produced as described for example 40 except that different CGM's and CTM's were used as indicated in Table 11. The layer thicknesses ($d_{CTL}$) of the CTL's are given in Table 11.

The electro-optical characteristics of the thus obtained photoconductive recording materials were determined as described above and the results are summarized together with those for the photoconductive recording material of example 41 in Table 11.

TABLE 11

| Example No. | CGM | CTM | $d_{CTL}$ [μm] | $I_{660}t$ = 20 mJ/m² CL [V] | RP [V] | % discharge |
|---|---|---|---|---|---|---|
| 40 | FASTOGEN BLUE 8120B | N1 | 10.1 | +541 | +126 | 76.7 |

TABLE 11-continued

| Example No. | CGM | CTM | $d_{CTL}$ [μm] | $I_{660}t$ = 20 mJ/m² CL [V] | RP [V] | % discharge |
|---|---|---|---|---|---|---|
| 43 | X-$H_2Pc(CN)_{0,36}$ | N2 | 12.1 | +487 | +99 | 79.7 |
| 44 | ω-$H_2TTP$ | N2 | 11.1 | +539 | +222 | 58.8 |

EXAMPLE 45

The photoconductive recording material of example 45 was produced as described for example 1 except that 3,5-diphenylaniline was used as the amine hardener instead of JEFFAMINE T-403 (tradename) and the CTM used was N1 instead of N3. The amounts of ARALDITE GT7203 (tradename) and 3,5-diphenylaniline were adjusted to obtain a theoretical degree of hardening of 100% corresponding with 41.8 wt % of ARALDITE GT7203 (tradename) and 8.2 wt % of 3,5-diphenylaniline. The CTL layer thickness was 11.1 μm.

The electro-optical characteristics of the thus obtained photoconductive recording material were determined as described above. At a charging level of +519V and an exposure $I_{660}t$ of 20 mJ/m², the following results were obtained:

CL=+519 V

RP=+137 V

% discharge=73.6

EXAMPLES 46 TO 48

The photoconductive recording materials of examples 46 to 48 were produced as described for example 1 except that with the exception of example 46 different epoxy resins (as indicated in Table 12) were used instead of ARALDITE GT7203 (tradename); 4-aminomethylpiperidine, a heterocyclic amine, was used as the amine hardener instead of JEFFAMINE T-403 (tradename) and different CTM's were used as indicated in Table 12. The amounts of epoxy resin and 4-aminomethylpiperidine were adjusted to obtain a theoretical degree of hardening of 100%. The weight percentages of the reactants based on their solids contents are given in Table 12 together with the CTL layer thicknesses ($d_{CTL}$).

The electro-optical characteristics of the thus obtained photoconductive recording materials were determined as described above and the results are summarized in Table 12.

TABLE 12

| Example No. | Epoxy resin | Epoxy resin conc. [wt %] | 4-aminomethylpiperidine conc. [wt %] | CTM | $d_{CTL}$ [μm] | $I_{660}t$ = 20 mJ/m² CL [V] | RP [V] | % discharge |
|---|---|---|---|---|---|---|---|---|
| 46 | ARALDITE GT7203 | 47.2 | 2.8 | N1 | 12.1 | +545 | +116 | 78.7 |
| 47 | ARALDITE GY281 | 40.63 | 9.37 | N2 | 14.1 | +442 | +131 | 70.4 |
| 48 | DEN 438 | 41.21 | 7.79 | N2 | 12.1 | +380 | +102 | 73.2 |

EXAMPLES 49 AND 50

The photoconductive recording materials of examples 49 and 50 were produced as described for example 46 except that different CGM's and CTM's were used as indicated in Table 13. The layer thicknesses of the CTL's are also given in Table 13.

The electro-optical characteristics of the thus obtained photoconductive recording materials were determined as described above and the results summarized together with those for the photoconductive recording material of example 47 in Table 13.

TABLE 13

| Example No. | CGM | CTM | $d_{CTL}$ [μm] | $I_{660}t$ = 20 mJ/m² CL [V] | RP [V] | % discharge |
|---|---|---|---|---|---|---|
| 46 | FASTOGEN BLUE 8120B | N1 | 12.1 | +545 | +116 | 78.7 |
| 49 | X-$H_2Pc(CN)_{0.36}$ | N2 | 11.1 | +499 | +94 | 81.2 |
| 50 | ω-$H_2TTP$ | N2 | 11.1 | +547 | +222 | 59.4 |

EXAMPLES 51 to 53

The photoconductive recording materials of examples 51 to 53 were produced as described for example 1 except that different aliphatic amines attached to an aromatic backbone were used as amine hardeners (as indicated in Table 14) instead of JEFFAMINE T-403 (tradename) and the CTM used was N1 instead of N3. The amounts of ARALDITE GT7203 (tradename) and the aliphatic amines were adjusted to obtain a theoretical degree of hardening of 100%. The weight percentages of the reactants based on their solids contents are given in Table 14 together with CTL layer thicknesses ($d_{CTL}$).

The electro-optical characteristics of the thus obtained photoconductive recording materials were determined as described above and the results are summarized in Table 14.

TABLE 14

| Example No. | ARALDITE GT7203 conc. | Aliphatic amine attached to an aromatic backbone | Aliphatic amine conc. [wt %] | $d_{CTL}$ [μm] | $I_{660}t$ = 20 mJ/m² CL [V] | RP [V] | % discharge |
|---|---|---|---|---|---|---|---|
| 51 | 36.77 | CARDOLITE NC541 | 11.23 | 13.1 | +542 | +125 | 76.9 |
| 52 | 41.66 | CARDOLITE NC541 LV | 8.34 | 12.1 | +540 | +117 | 78.3 |
| 53 | 47.07 | EPILINK MX | 2.93 | 11.1 | +552 | +137 | 75.2 |

EXAMPLES 54

The photoconductive recording material of example 54 was produced as described for example 1 except that a modified isophoron diamine, EPILINK 420 (tradename from Akzo), was used as the amine hardener instead of JEFFAMINE T-403 (tradename) and the CTM used was N1 instead of N3. The amounts of ARALDITE GT7203 (tradename) and EPILINK 420 (tradename) were adjusted to obtain a theoretical degree of hardening of 100% yielding 40.04 wt % of ARALDITE GT7203 (tradename) and 9.96 wt % of EPILINK 420 (tradename). The CTL layer thickness was 13.1 μm.

The electro-optical characteristics of the thus obtained photoconductive recording material were determined as described above. At a charging level of +544 V and an exposure $I_{660}t$ of 20 mJ/m², the following results were obtained:

CL=+544 V
RP=+135 V
% discharge=75.2

EXAMPLES 55 AND 56

The photoconductive recording materials of examples 55 and 56 were produced as described for example 1 except that 2,4,6-tris(dimethylaminophenyl)phenol was used as a catalyst to induce selfcrosslinking of the ARALDITE GT7203 (tradename) instead of the reactive amine hardener JEFFAMINE T-403 (tradename), and different CTM's were used as indicated in Tabel 15 and the charge generating layers of the photoconductive recording materials were only hardened for 1 hour at 100° C. instead of 2 hours. The weight percentages of ARALDITE GT7203 (tradename) and 2,4,6-tris(dimethylaminomethyl)phenol (TDMAMP) are given in Table 15 together with the CTL layer thicknesses ($d_{CTL}$).

The electro-optical characteristics of the thus obtained photoconductive recording materials were determined as described above and the results summarized in Table 15.

TABLE 15

| Example No. | ARALDITE GT7203 conc. [wt %] | TDMAMP conc. [wt %] | CTM | $d_{CTL}$ [μm] | $I_{660}t$ = 20 mJ/m² CL [V] | RP [V] | % discharge |
|---|---|---|---|---|---|---|---|
| 55 | 47 | 3 | N3 | 12.1 | +500 | +114 | 77.2 |
| 56 | 48 | 2 | N2 | 13.1 | +548 | +129 | 76.5 |

What is claimed is:

1. A photoconductive recording material containing a support and a charge generating layer (GCL) in contiguous relationship with a charge transporting layer (CTL), containing a n-charge transporting material (n-CTM), wherein the binder of said charge generating layer (CGL) is made insoluble in methylene chloride by crosslinking, and said crosslinked binder consists of one or more polyepoxy compounds which have been self-crosslinked under the influence of an amine catalyst and/or have been crosslinked by reaction with at least one primary and/or secondary poly NH-group amine.

2. Photoconductive recording material according to claim 1, wherein said charge generating layer contains one or more polyepoxy compounds self-crosslinked in the presence of one or more catalytically acting amines wherein the concentration of said amines is between 2 and 15% by weight of the total weight of said polyepoxy compounds and amines.

3. Photoconductive recording material according to claim 1, wherein said charge generating layer contains a binder having polymeric structure derived from one or more polyepoxy compounds crosslinked with one or more of said polyamines wherein the equivalent ratio of the totality of epoxy groups and NH present in said poly NH-group amines is between 3.0:1 and 1:3.0.

4. Photoconductive recording material according to claim 1, wherein the amino group or groups of said amine catalyst and/or said primary and/or secondary poly NH-group amines active in said crosslinking, taking place in said charge generating layer, was(were) blocked to render the groups inactive prior to said crosslinking.

5. Photoconductive recording material according to claim 1, wherein said support consists of aluminum or is a support provided with an aluminum layer forming a conductive coating.

6. Photoconductive recording material according to claim 1, wherein said polyepoxy compounds serving as crosslinking agents have a formula selected from the group consisting of (I), (II), (III), (IV) and (V):

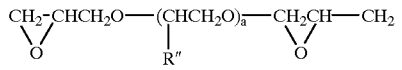

(I)

wherein R" is an alkyl group and a≧0;

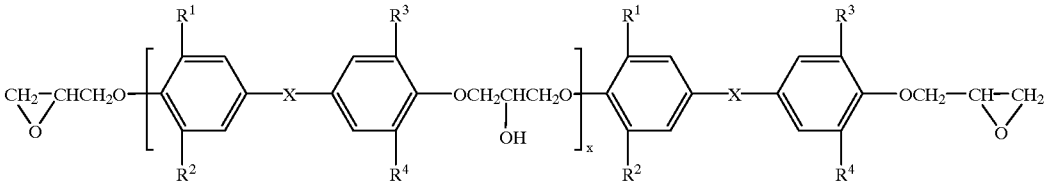

(II)

which: X represents S, $SO_2$,

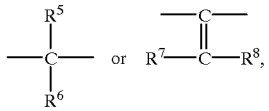

each of $R^1$, R2, $R^3$, $R^4$, $R^7$ and $R^8$ (same or different) represents hydrogen, halogen, an alkyl group or an aryl group; each of $R^5$ and $R^6$ (same or different) represents hydrogen, an alkyl group, an aryl group or together represent the necessary atoms to close a cycloaliphatic ring; and c is zero or an integer;
(III)
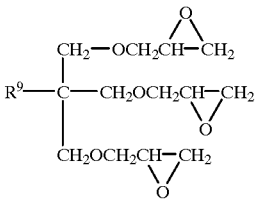
wherein $R^9$ is an alkyl group;
(IV)
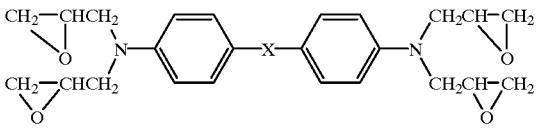
wherein x has the same meaning as above;
(V)
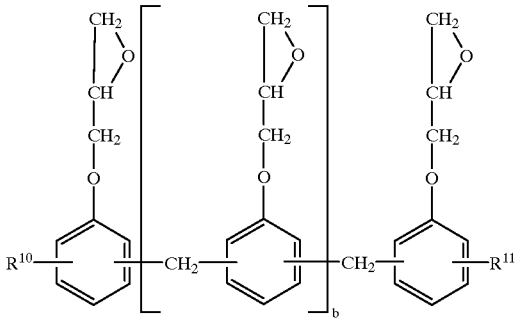
wherein each of $R^{10}$ and $R^{11}$ (same or different) represents hydrogen or an alkyl group and $b \geqq 0$.
* * * * *